US007152263B1

(12) United States Patent
Delfs

(10) Patent No.: US 7,152,263 B1
(45) Date of Patent: Dec. 26, 2006

(54) MULTI-LAYER MULTI-CHAMBER PILLOW WITH UNFILLED CENTER CHAMBER IN THE TOP LAYER

(75) Inventor: Juliette M. Delfs, Seattle, WA (US)

(73) Assignee: Pacific Coast Feather Company, Seattle, WA (US)

( * ) Notice: Subject to any disclaimer, the term of this patent is extended or adjusted under 35 U.S.C. 154(b) by 0 days.

(21) Appl. No.: 11/192,605

(22) Filed: Jul. 29, 2005

(51) Int. Cl.
*A47G 9/10* (2006.01)

(52) U.S. Cl. ..... 5/636; 5/645

(58) Field of Classification Search ..... 5/636, 5/639, 640, 644, 645
See application file for complete search history.

(56) References Cited

U.S. PATENT DOCUMENTS 1,020,444 A 3/1912 Platt
1,385,355 A 7/1921 Banks
2,589,303 A * 3/1952 Sourbeck ..... 5/645
2,805,428 A * 9/1957 Buchman ..... 5/645
2,883,681 A 4/1959 Caplan
3,216,027 A * 11/1965 Jackson ..... 5/640
4,660,239 A * 4/1987 Thomas ..... 5/645
4,908,894 A 3/1990 Sanders
5,038,432 A * 8/1991 Robillard et al. ..... 5/645
5,363,524 A 11/1994 Lang
5,367,731 A 11/1994 O'Sullivan
5,471,691 A * 12/1995 Ryndak ..... 5/645
5,644,810 A 7/1997 Kato
5,708,998 A 1/1998 Torbik
5,809,597 A * 9/1998 Shaw ..... 5/655.3
5,819,347 A 10/1998 Masuda

* cited by examiner

*Primary Examiner*—Michael Trettel
(74) *Attorney, Agent, or Firm*—Jensen & Puntigam, P.S.

(57) ABSTRACT

The multi-layer pillow includes an upper layer which includes at least two chambers in addition to a center chamber and a lower layer which includes at least three chambers arranged laterally side-by-side. The first and second layers have approximately the same outline and are secured together around the peripheries thereof. There is filling in at least the three chambers of the lower layer and in at least the two chambers of the upper layer, with no filling in the center chamber of the upper layer.

17 Claims, 2 Drawing Sheets

FIG.1
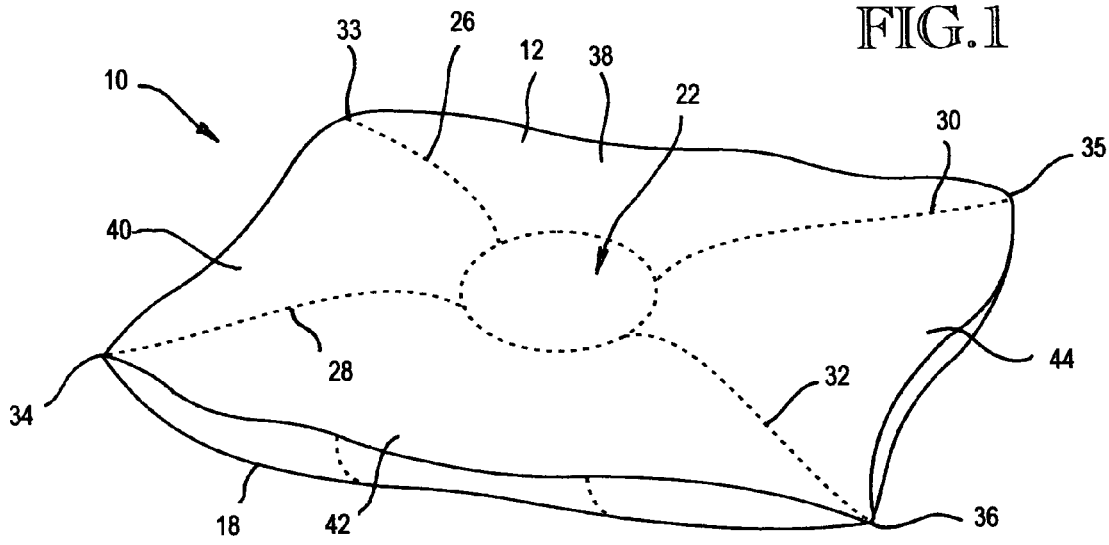
FIG.2
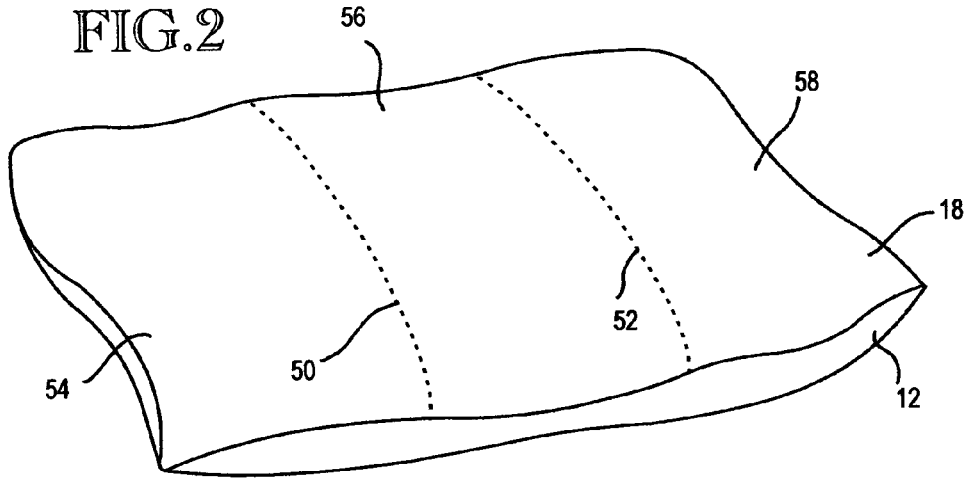
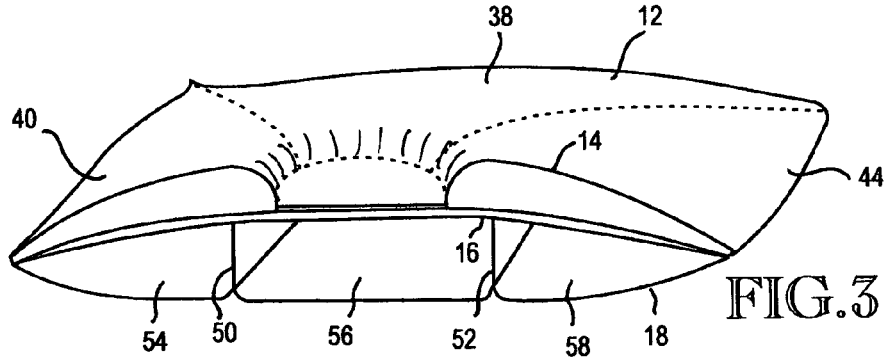
FIG.3

FIG.4
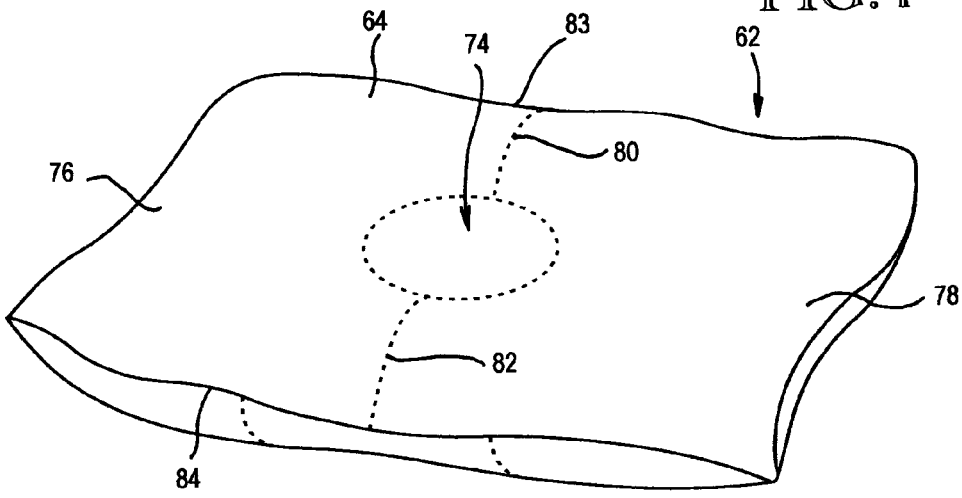
FIG.5
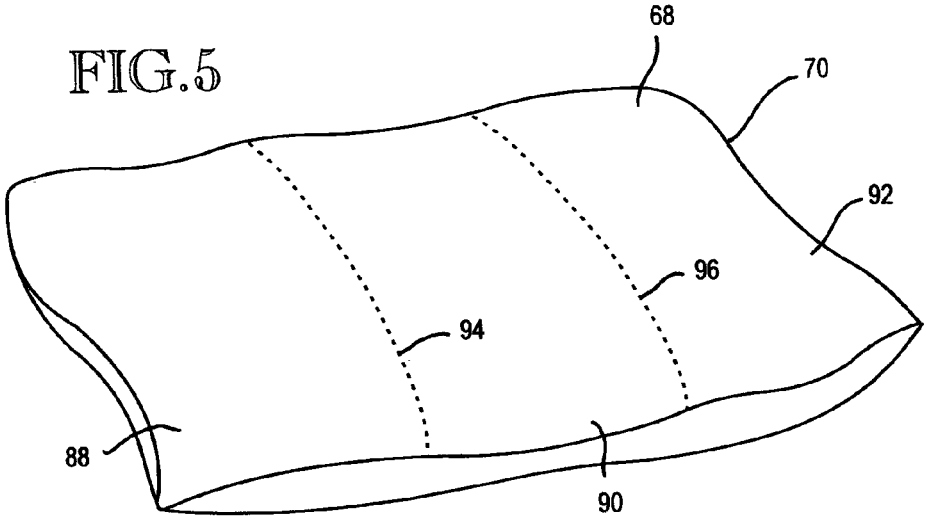
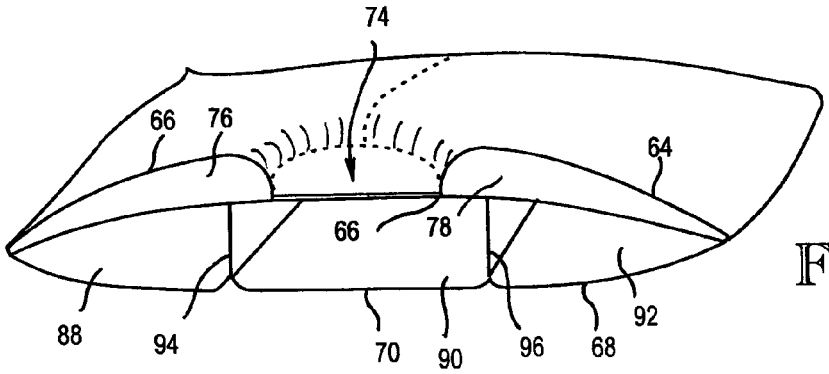
FIG.6

MULTI-LAYER MULTI-CHAMBER PILLOW WITH UNFILLED CENTER CHAMBER IN THE TOP LAYER

TECHNICAL FIELD

This invention relates generally to a multi-layer pillow, and more specifically concerns a multi-layer pillow having more than one chamber in each layer.

BACKGROUND OF THE INVENTION

The primary purpose of a pillow is to provide support for the head and neck regions of a sleeper (user). The type of support required will vary depending upon the primary sleep position of the user. In the back sleeping position, the user requires less head support and more neck support, while when the user is on his/her side, more support is required for the head than the neck region. Generally, pillows are designed to provide a specific pattern of support, which typically cannot be varied. A different type of support requires a completely different pillow.

It would be desirable to have a basic pillow configuration with a multiple chamber arrangement, in which the chambers can be filled differently by the manufacturer to provide different kinds of support for the user. A manufacturer would thus be able to produce the same basic pillow configuration, but with different support characteristics, depending upon the kind/quantity of the fill in the various chambers.

SUMMARY OF THE INVENTION

Accordingly, the present invention is a multi-layer pillow, comprising: an upper pillow layer which includes at least two chambers in addition to a center chamber; a lower pillow layer which includes at least three chambers arranged side-by-side, wherein the first and second layers have approximately the same outline and are secured together around the peripheries thereof; and filling in the three chambers in the lower layer and in at least two chambers of the upper layer, wherein the center chamber has substantially no filling therein.

BRIEF DESCRIPTION OF THE DRAWINGS

FIG. 1 is a top view of a first embodiment of the multi-layer pillow.

FIG. 2 is a bottom/back view of the pillow of FIG. 1.

FIG. 3 is a cut-away view of the pillow of FIG. 1.

FIG. 4 is a top view of a second embodiment of the multi-layer pillow.

FIG. 5 is a back/bottom view of the pillow of FIG. 4.

FIG. 6 is a cut-away view of the pillow of FIG. 4.

BEST MODE FOR CARRYING OUT THE INVENTION

FIGS. 1, 2 and 3 show a first embodiment of the multi-layer pillow. This embodiment, shown generally at 10, includes four substantially identical rectangular fabric sheet members 12, 14, 16 and 18 which are secured together around their respective peripheries. The upper two sheets 12 and 14 form the upper layer of the pillow, while the lower two sheets 16 and 18 form the lower layer of the pillow.

In the embodiment of FIGS. 1–3, a center chamber 22 is defined by sewing sheets 12 and 14 together, referred to as sewn through. In the embodiment shown, center chamber 22 is circular in configuration, although it could be other configurations, including oval, rectangular, etc. Further, center chamber 22 could be defined by a continuous baffle or other attachment means as well as by sewing.

A plurality of chambers in the upper layer are formed by lines of stitching 26, 28, 30 and 32 which extend between sheets 12 and 14 (sewn through) and respectively from the four corners 33, 34, 35 and 36 of the two sheets 12 and 14 to the boundary of center chamber 22. The lines of stitching extend from the sheet corners generally in a straight line toward the opposing corner of the pillow, terminating at center chamber 22. While lines of stitching are used to define the chambers 38, 40, 42, and 44 in the upper layer, other attachment means, including separate baffle members could be used to define those same chambers.

In the lower layer, baffle members 50 and 52 are sewn to and positioned between sheets 16 and 18. In the embodiment shown, the two baffle members extending in the lateral direction (across the width) of the pillow, dividing the lower layer into approximately three side-by-side chambers 54, 56 and 58. In the embodiment shown, the three chambers 54, 56 and 58 have substantially the same width, although the width of the chambers can be varied depending upon the particular application. Furthermore, there could be a greater number of chambers than three, if so desired, using more than two baffle members. Further, the baffle members could alternatively extend longitudinally (along the length) of the pillow, dividing the lower layer into three or more longitudinal chambers.

Although the upper and lower layers are each defined by two sheets of fabric, it is possible that the two layers could share a single intermediate sheet, in a modified form of the pillow of FIGS. 1–3.

Chambers 26, 28, 40 and 42 of the upper layer and chambers 54, 56, and 58 of the lower layer are filled either with a man-made fiber, such as polyester, or a natural fiber, such as feathers and/or down or some combination thereof. Further, some chambers could have one type or combination of filling, while other chambers could have different fillings or combinations of fillings. Further, the quantity of the fill in the chambers can be different between the various chambers. The kind of fill and the quantity of fill in the various chambers will change the support characteristics of the pillow, even though the basic pillow configuration (the tick) remains the same. Alternatively, the location of the lines of stitching in the upper and/or lower layers could be changed somewhat to change the support characteristics of a pillow with the amount of filling remaining the same in the chambers. Typically, there will be no filling between sheets 14 and 16, although this could be done, if so desired.

The center chamber 22 has little or no filling, thereby defining a small cavity or depressed region in the center of the upper layer. The unfilled center area plus use of different fills in the various chambers permits the same basic pillow design, i.e. a multi-layer pillow with several chambers in each layer, to be used for a wide variety of support requirements. Hence, the manufacturer can offer a single pillow configuration but with different fills to provide different modes of support, or alternatively, the location of the lines of stitching could be altered somewhat during manufacturing, to satisfy the different support needs of customers.

More specifically, for a standard size pillow, using all down material, the top layer will have 4–6 oz. total fill (all chambers) for a sewn-through arrangement, or 5–9 oz. total fill for a baffled arrangement. The bottom layer, which is baffled, will have 5–16 oz. total fill. With down in the top layer and feathers in the lower layer, the top layer will also have a total fill of 4–6 oz. for a sewn-through arrangement and 5–9 oz. for a baffled arrangement, while the baffled lower layer will have a total fill of 16–26 oz.

FIGS. 4–6 show a second embodiment of the multi-layer pillow. This embodiment of the pillow, shown generally at 62, includes three substantially identical rectangular fabric sheet members 64, 66 and 68 secured together around their respective peripheries. Sheet members 64 and 66 define the upper layer of the pillow, while sheet members 66 and 68 define the lower layer of the pillow. Alternatively, four sheet members could be used, as with the embodiment of FIGS. 1–3. A center chamber 74 is also defined in this embodiment using a line of stitching connecting sheets 64 and 66 or a baffle member or other attachment means providing a similar boundary.

The remainder of the upper layer is divided into two chambers 76 and 78 by sewn lines (lines of stitching) 80 and 82 which extend respectively from the opposing longitudinal sides 83 and 84 of the pillow to the center chamber 74. In the embodiment shown, lines 80 and 82 are positioned at approximately a longitudinal midpoint of the pillow. Alternatively, the lines of stitching could extend in a longitudinal direction at approximately a lateral midpoint of the pillow.

The lower layer of the pillow is constructed similar to that embodiment of FIGS. 1–3, with three chambers 88, 90, and 92 being defined by baffle members 94 and 96, although this could be done with lines of stitching between sheet members 66 and 68 as well. Center chamber 74 is unfilled as with the first embodiment, with the remaining chambers of the pillow being filled with a selected type filling and quantity of filling to provide the specific support characteristics desired, as described above.

Accordingly, a new pillow has been shown and described which is configured to permit different support characteristics depending upon the particular filling within the various chambers of the upper and lower layers of the pillow.

Although a preferred embodiment of the invention has been disclosed for purposes of illustration, it should be understood that various changes, modifications and substitutions may be incorporated in the embodiment without departing from the spirit of the invention which is defined by the claims as follows.

What claimed is:

1. A multi-layer pillow, comprising:

an upper pillow layer which includes at least two chambers in addition to a center chamber, wherein the center chamber is surrounded by said at least two chambers, such that the center chamber does not extend to an edge of the upper pillow layer;

a lower pillow layer which includes at least three chambers arranged side-by-side, wherein the first and second layers have approximately the same outline and are secured together around the peripheries thereof; and filling in the three chambers in the lower layer and in the at least two chambers of the upper layer, wherein the center chamber has substantially no filling therein.

2. The pillow of claim 1, wherein the chambers in the lower layer are substantially identical in size and configuration.

3. The pillow of claim 1, wherein the chambers in the lower layer extend laterally across the width of the pillow.

4. The pillow of claim 1, wherein the chambers in the lower layer extend longitudinally along the length of the pillow.

5. The pillow of claim 4, wherein the chambers in the upper layer are defined by connections which extend from the corners of the pillow toward opposing corners, terminating at the center chamber.

6. The pillow of claim 5, wherein the connections are lines of stitching.

7. The pillow of claim 5, wherein the connections are baffle members.

8. The pillow of claim 1, wherein the center chamber is substantially circular in outline.

9. The pillow of claim 1, wherein the chambers in the upper layer are defined by connections which extend laterally of the pillow, which bisect the pillow in two laterally extending sections.

10. The pillow claim 9, wherein the connections are lines of stitching.

11. The pillow of claim 9, wherein the connections are baffle members.

12. The pillow of claim 1, wherein the chambers in the upper layer are defined by connections which extend longitudinally of the pillow, which bisect the pillow into two longitudinally extending sections.

13. The pillow of claim 1, wherein the center chamber is defined by a line of stitching.

14. The pillow of claim 1, wherein the upper layer includes two upper sheet members and the lower layer includes two lower sheet members.

15. The pillow of claim 1, wherein the upper layer includes an upper sheet member and the lower layer includes a lower sheet member, and wherein the upper and lower layers share an intermediate sheet member.

16. The pillow of claim 1, wherein the quantity of filling differs between those chambers which have filling in them.

17. The pillow of claim 1, wherein the type of filling differs between the chambers which have filling in them.

* * * * *